US012578116B2

(12) United States Patent
Kim et al.

(10) Patent No.: US 12,578,116 B2
(45) Date of Patent: Mar. 17, 2026

(54) AIR CONDITIONER

(71) Applicant: LG ELECTRONICS INC., Seoul (KR)

(72) Inventors: Daehyoung Kim, Seoul (KR); Yongcheol Sa, Seoul (KR); Jiyoung Jang, Seoul (KR); Chiwoo Song, Seoul (KR); Jisung Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 127 days.

(21) Appl. No.: 18/384,084

(22) Filed: Oct. 26, 2023

(65) Prior Publication Data

US 2024/0142131 A1 May 2, 2024

(30) Foreign Application Priority Data

Oct. 31, 2022 (KR) ..... 10-2022-0142263

(51) Int. Cl.
*F24F 11/84* (2018.01)
*F24F 1/0035* (2019.01)
(Continued)

(52) U.S. Cl.
CPC ..... *F24F 11/84* (2018.01); *F24F 1/0035* (2019.02); *F24F 11/46* (2018.01); *F24F 11/63* (2018.01);
(Continued)

(58) Field of Classification Search
CPC .. F24F 11/46; F24F 11/63; F24F 11/84; F24F 2140/12; F24F 2140/20; F24F 13/24; F24F 2221/54
See application file for complete search history.

(56) References Cited

U.S. PATENT DOCUMENTS 5,263,333 A 11/1993 Kubo et al.
2022/0018581 A1 1/2022 Song et al.

FOREIGN PATENT DOCUMENTS

EP 2551614 1/2013
EP 3919835 12/2021
(Continued)

OTHER PUBLICATIONS

Extended European Search Report dated Apr. 4, 2024, issued in Application No. 23205684.6.
(Continued)

*Primary Examiner* — Nael N Babaa
(74) *Attorney, Agent, or Firm* — KED & ASSOCIATES

(57) ABSTRACT

An air conditioner is provided that may include an outdoor unit provided with a compressor; a plurality of indoor units connected to the outdoor unit, each having an indoor heat exchanger, and each disposed in a different space; a low pressure pipe that connects the indoor heat exchanger and the compressor and in which low pressure gaseous refrigerant flows; a switching device provided with a low pressure valve disposed between the indoor heat exchanger and the low pressure pipe; an indoor temperature sensor that measures a temperature of a space in which an indoor unit of the respective indoor unit is disposed; and a controller that is electrically connected to the indoor temperature sensor and adjusts an opening degree of the low pressure valve. The controller may adjust the opening degree of the low pressure valve based on a difference between a value measured by the indoor temperature sensor and a previously input set temperature. By increasing an evaporation pressure in the indoor unit, noise from the air conditioner may be suppressed or prevented and comfort improved.

20 Claims, 6 Drawing Sheets

(51) Int. Cl.

| | |
|---|---|
| ***F24F 11/46*** | (2018.01) |
| ***F24F 11/63*** | (2018.01) |
| *F24F 13/24* | (2006.01) |
| *F24F 140/12* | (2018.01) |
| *F24F 140/20* | (2018.01) |

(52) U.S. Cl.
CPC ..... *F24F 13/24* (2013.01); *F24F 2140/12* (2018.01); *F24F 2140/20* (2018.01); *F24F 2221/54* (2013.01)

(56) References Cited

FOREIGN PATENT DOCUMENTS

| | | |
|---|---|---|
| JP | 7086231 | 6/2022 |
| KR | 10-1996-0001572 | 2/1996 |
| KR | 10-2010-0036788 | 4/2010 |
| KR | 10-2013-0012743 | 2/2013 |
| KR | 10-2019-0035057 | 4/2019 |

OTHER PUBLICATIONS

Korean Office Action issued in Application No. 10-2022-0142263 dated Jan. 14, 2025.
Korean Notice of Allowance issued in Application No. 10-2022-0142263 dated Aug. 22, 2025.

FIG. 6

Temperature gap = T243 − T242 ~M1

Target evaporation pressure($P_f$) = P+α(T1 − $T_{set}$) ~M2

Low pressure valve opening amount(Li) = Current opening amount(Li−1) + β($P_f$ − $P_s$) ~M3

AIR CONDITIONER

CROSS-REFERENCE TO RELATED APPLICATION(S)

This application claims priority under 35 U.S.C. § 119 to Korean Application No. 10-2022-0142263, filed in Korea on Oct. 31, 2022, whose entire disclosure is hereby incorporated by reference.

BACKGROUND

1 Field

An air conditioner, and more specifically, an air conditioner having a plurality of indoor units is disclosed herein.

2. Background

An air conditioner is a device that exchanges heat with suctioned air and supplies the heat-exchanged air indoors. The air conditioner includes an outdoor unit provided with a compressor and an indoor unit connected to the outdoor unit through a refrigerant pipe.

The outdoor unit of the air conditioner may be connected to a plurality of indoor units, and thus, include a switching device that connects the outdoor unit to the plurality of indoor units. The air conditioner provided with the plurality of indoor units turns the indoor units on or off depending on a temperature of an indoor space. For example, in the case of a cooling operation, when the temperature of the indoor space falls below a certain or predetermined level, the indoor unit in the space is turned off, and when the temperature rises above a certain or predetermined level, the indoor unit in the space is turned back on.

However, conventional air conditioners have an issue with excessive power consumption generated by the compressor, as the compressor is repeatedly turned on and off due to frequent on/off switching of the indoor unit. In addition, conventional air conditioners have an issue of causing discomfort to users because excessively cold air is supplied to users when the indoor unit is on, and lukewarm and humid air when the indoor unit is off.

BRIEF DESCRIPTION OF THE DRAWINGS

Embodiments will be described in detail with reference to the following drawings in which like reference numerals refer to like elements wherein:

FIG. 6 is a formula for controlling an air conditioner according to an embodiment.

DETAILED DESCRIPTION

Figure 1:
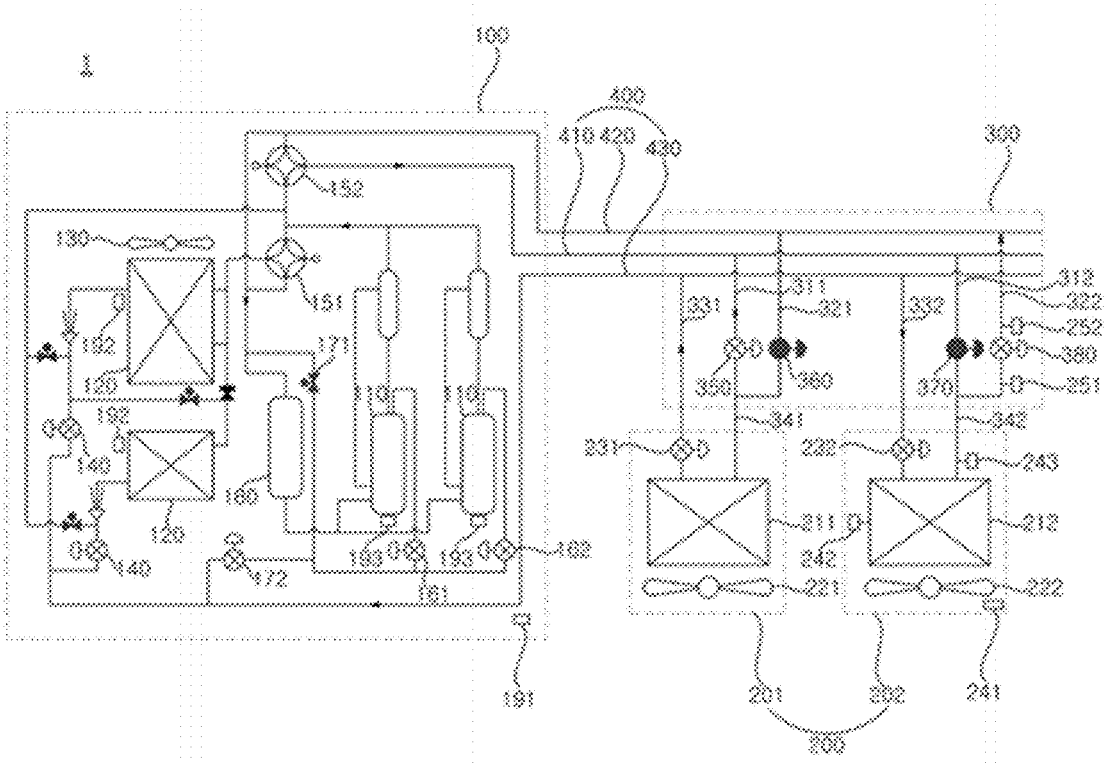
FIG. 1 is a schematic diagram of air conditioner according to an embodiment.

Hereinafter, embodiments are described with reference to accompanying drawings and regardless of the drawings symbols, the same or similar components are assigned the same reference numerals, and thus, overlapping description thereof has been omitted.

With respect to constituents used in the following description, the suffixes "module" and "unit" are merely given or used interchangeably in consideration of only facilitation of description and do not have any special importance or role.

In addition, in describing embodiments, when it is determined that description of related known technology may obscure the gist of the embodiments described in this specification, the description thereof has been omitted. In addition, the attached drawings are only for easy understanding of the embodiments described in this specification, and the technical idea described in this specification is not limited by the attached drawings. It should be understood that all modifications, equivalents, and substitutes included in the spirit and technical scope are included.

Terms containing ordinal numbers such as "first" and "second" may be used to describe various components, but the components are not restricted by the terms. The terms are used only to distinguish one component from another component.

It will be understood that when a component is referred to as being "connected" or "coupled" to another component, the two components may be directly connected or coupled to each other, or intervening components may be present between the two components. It will be understood that when a component is referred to as being "directly connected or coupled", no intervening components are present between the two components.

A singular expression includes a plural expression, unless the context clearly states otherwise.

Referring to FIG. 1, an air conditioner 1 will be described. FIG. 1 conceptually illustrates a flow of refrigerant circulating within the air conditioner 1.

The air conditioner 1 may include an outdoor unit 100. The outdoor unit 100 may be disposed in an outdoor space.

The air conditioner 1 may include an indoor unit 200. The indoor unit 200 may be disposed in an indoor space. The indoor unit 200 may be connected to the outdoor unit 100 through a refrigerant pipe 400.

A plurality of indoor units 200 may be provided. Each of the plurality of indoor units 200 may be connected to the outdoor unit 100 through the refrigerant pipe 400. The plurality of indoor units 200 may include first indoor unit 201 and second indoor unit 202. Each of the first and second indoor units 201 and 202 may be driven in a cooling mode or a heating mode. In FIG. 1, the number of indoor units 200 is shown and described as two as an example; however, the number of indoor units 200 is not limited thereto. In other words, the number of indoor units 200 may be more than two.

The air conditioner 1 may include a switching device 300. The switching device 300 may connect the outdoor unit 100 and the indoor unit 200. The switching device 300 may supply the refrigerant introduced from the outdoor unit 100 to the plurality of indoor units 200. The switching device 300 may supply the refrigerant discharged from the indoor unit 200 to the outdoor unit 100.

The air conditioner 1 may include the refrigerant pipe 400. The refrigerant pipe 400 may connect the outdoor unit 100 and the switching device 300.

The air conditioner 1 may include a compressor 110. The compressor 110 may be disposed inside of the outdoor unit 100. A plurality of compressors 110 may be provided.

The air conditioner 1 may include an outdoor heat exchanger 120. The outdoor heat exchanger 120 may be disposed inside of the outdoor unit 100. A plurality of outdoor heat exchangers 120 may be provided. The outdoor heat exchanger 120 may be connected to the compressor 110.

The air conditioner 1 may include an outdoor fan 130. The outdoor fan 130 may be disposed inside of the outdoor unit 100. The outdoor fan 130 may blow air toward the outdoor heat exchanger 120.

The air conditioner 1 may include an outdoor expansion valve 140. The outdoor expansion valve 140 may be disposed inside of the outdoor unit 100. The outdoor expansion valve 140 may be connected to the outdoor heat exchanger 120. A plurality of outdoor expansion valves 140 may be provided to correspond to each of the plurality of outdoor heat exchangers 120.

The air conditioner 1 may include a first four-way valve 151. The first four-way valve 151 may be connected to the compressor 110. The first four-way valve 151 may be connected to the outdoor heat exchanger 120.

The air conditioner 1 may include a second four-way valve 152. The second four-way valve 152 may be connected to the compressor 110. The second four-way valve 152 may be connected to the outdoor heat exchanger 120. The second four-way valve 152 may be connected to the refrigerant pipe 400. The second four-way valve 152 may be connected to the switching device 300.

The air conditioner 1 may include a first outdoor valve 161. The first outdoor valve 161 may be disposed inside of the outdoor unit 100. The first outdoor valve 161 may be connected to the compressor 110.

The air conditioner 1 may include a second outdoor valve 162. The second outdoor valve 162 may be disposed inside of the outdoor unit 100. The second outdoor valve 162 may be connected to the compressor 110.

The air conditioner 1 may include a suction valve 171. The suction valve 171 may be disposed inside of the outdoor unit 100. The suction valve 171 may be connected to the compressor 110. The suction valve 171 may be connected to an accumulator 180.

The air conditioner 1 may include a supercooling valve 172. The supercooling valve 172 may be disposed inside of the outdoor unit 100. The supercooling valve 172 may be connected to the compressor 110.

The air conditioner 1 may include the accumulator 180. The accumulator 180 may be disposed inside of the outdoor unit 100. The accumulator 180 may be connected to the compressor 110.

The air conditioner 1 may include a controller 191. The controller 191 may be disposed in the outdoor unit 100. The controller 191 may control driving of the outdoor unit 100, the indoor unit 200, and the switching device 300.

The air conditioner 1 may include an outdoor temperature sensor 192. The outdoor temperature sensor 192 may be disposed in the outdoor unit 100. The outdoor temperature sensor 192 may measure a temperature of the outdoor heat exchanger 120.

The air conditioner 1 may include an oil sensor 193. The oil sensor 193 may be disposed in the outdoor unit 100. The oil sensor 193 may sense an amount of oil in the compressor 110.

A plurality of indoor units 200 may be provided. The indoor unit 200 may include the first indoor unit 201. The indoor unit 200 may include the second indoor unit 202. Each of the first indoor unit 201 and the second indoor unit 202 may include indoor heat exchangers 211 and 212, indoor fans 221 and 222, and indoor expansion valves 231 and 232. The first indoor unit 201 and the second indoor unit 202 may be driven in different modes or in the same mode during cooling or heating.

The first indoor unit 201 may include first indoor heat exchanger 211. The first indoor heat exchanger 211 may be disposed inside of the first indoor unit 201 and connected to the switching device 300.

The first indoor unit 201 may include first indoor fan 221. The first indoor fan 221 may blow air toward the first indoor heat exchanger 211.

The first indoor unit 201 may include first indoor expansion valve 231. The first indoor expansion valve 231 may be connected to the first indoor heat exchanger 211.

The second indoor unit 202 may include second indoor heat exchanger 212. The second indoor heat exchanger 212 may be disposed inside of the second indoor unit 202 and connected to the switching device 300.

The second indoor unit 202 may include second indoor fan 222. The second indoor fan 222 may blow air toward the second indoor heat exchanger 212.

The second indoor unit 202 may include second indoor expansion valve 232. The second indoor expansion valve 232 may be connected to the second indoor heat exchanger 212.

The refrigerant pipe 400 may include a high pressure pipe 410. A high temperature and high pressure refrigerant may flow through the high pressure pipe 410. The high pressure pipe 410 may be connected to the compressor 110. A gaseous refrigerant may flow inside of the high pressure pipe 410.

The refrigerant pipe 400 may include a low pressure pipe 420. A low pressure refrigerant may flow in the low pressure pipe 420. The low pressure pipe 420 may be connected to the outdoor heat exchanger 120 and the indoor heat exchangers 211 and 212. A gaseous refrigerant may flow inside of the low pressure pipe 420.

The refrigerant pipe 400 may include a liquid pipe 430. A low-temperature and low pressure refrigerant may flow through the liquid pipe 430. The liquid pipe 430 may be connected to the expansion valves 140, 231, and 232. A liquid refrigerant may flow inside of the liquid pipe 430.

The refrigerant pipe 400 may be connected to the switching device 300. The refrigerant flowing inside of the refrigerant pipe 400 may be supplied to the switching device 300 or may flow from the switching device 300 to the refrigerant pipe 400. The refrigerant pipe 400 may be divided into a first refrigerant pipe that supplies refrigerant to the switching device 300 and a second refrigerant pipe through which refrigerant is introduced from the switching device 300.

The switching device 300 may include high pressure pipe connectors 311 and 312. The high pressure pipe connectors 311 and 312 may be connected to the high pressure pipe 410. The high pressure pipe connectors 311 and 312 may include first high pressure pipe connector 311 connected to the first indoor unit 201. The high pressure pipe connectors 311 and 312 may include second high pressure pipe connector 312 connected to the second indoor unit 202.

The switching device 300 may include low pressure pipe connectors 321 and 322. The low pressure pipe connectors 321 and 322 may be connected to the low pressure pipe 420. The low pressure pipe connectors 321 and 322 may include first low pressure pipe connector 321 connected to the first indoor unit 201. The low pressure pipe connectors 321 and 322 may include second low pressure pipe connector 322 connected to the second indoor unit 202.

The switching device 300 may include liquid pipe connectors 331 and 332. The liquid pipe connectors 331 and 332 may be connected to the liquid pipe 430. The liquid pipe connectors 331 and 332 may include first liquid pipe connector 331 connected to the first indoor unit 201. The liquid pipe connectors 331 and 332 may include second liquid pipe connector 332 connected to the second indoor unit 202.

The switching device 300 may include indoor unit connectors 341 and 342. The indoor unit connectors 341 and 342 may be connected to the indoor unit 200. The indoor unit connectors 341 and 342 may include first indoor unit connector 341 connected to the first indoor unit 201. The indoor unit connectors 341 and 342 may include second indoor unit connector 342 connected to the second indoor unit 202.

The switching device 300 may include high pressure valves 350 and 370. The high pressure valves 350 and 370 may be connected to the high pressure pipe 410. The high pressure valves 350 and 370 may include first high pressure valve 350 connected to the first high pressure pipe connector 311. The high pressure valves 350 and 370 may include second high pressure valve 370 connected to the second high pressure pipe connector 312.

The switching device 300 may include low pressure valves 360 and 380. The low pressure valves 360 and 380 may be connected to the low pressure pipe 420. The low pressure valves 360 and 380 may include first low pressure valve 360 connected to the first low pressure pipe connector 321. The low pressure valves 360 and 380 may include second low pressure valve 380 connected to the second low pressure pipe connector 322.

The refrigerant circulating in the air conditioner 1 may flow as shown in FIG. 1. FIG. 1 illustrates a refrigerant flow when the first indoor unit 201 is operated in a heating mode and the second indoor unit 202 is operated in a cooling mode.

The refrigerant discharged from the compressor 110 may pass through the second four-way valve 152 and be introduced into the high pressure pipe 410. The first high pressure valve 350 may be in an open state, and the second high pressure valve 370 may be in a closed state. The refrigerant introduced into the high pressure pipe 410 may be introduced into the first indoor heat exchanger 211 through the first high pressure pipe connector 311. The refrigerant introduced into the first indoor heat exchanger 211 may exchange heat with indoor air and be condensed, then pass through the first indoor expansion valve 231 and be introduced into the liquid pipe 430. A portion of the refrigerant introduced into the liquid pipe 430 may be introduced into the outdoor heat exchanger 120, evaporate, and then be introduced into the compressor 110. The first low pressure valve 360 may be in a closed state, and the second low pressure valve 380 may be in an open state. A remaining portion of the refrigerant introduced into the liquid pipe 430 may be introduced into the second indoor heat exchanger 212 through the second liquid pipe connector 332. The refrigerant introduced into the second indoor heat exchanger 212 may exchange heat with indoor air and evaporate, and then be introduced into the compressor 110 through the low pressure pipe 420.

Due to the aforementioned refrigerant flow, the first indoor unit 201 may be operated in the heating mode, and the second indoor unit 202 may be operated in the cooling mode.

The air conditioner 1 may include an indoor temperature sensor 241. The indoor temperature sensor 241 may be disposed in the indoor unit 200. The indoor temperature sensor 241 may measure a temperature of an indoor space. The indoor temperature sensor 241 may be electrically connected to the controller 191. The indoor temperature sensor 241 may transmit information about the temperature of the indoor space to the controller 191.

The air conditioner 1 may include a superheat sensor 242. The superheat sensor 242 may be disposed in the indoor heat exchanger 212. The superheat sensor 242 may measure a temperature of the indoor heat exchanger 212. The superheat sensor 242 may measure a temperature of the refrigerant passing through the indoor heat exchanger 212. The superheat sensor 242 may be electrically connected to the controller 191. The superheat sensor 242 may transmit information about the temperature of the indoor heat exchanger 212 to the controller 191.

The air conditioner 1 may include a discharge temperature sensor 243. The discharge temperature sensor 243 may measure a temperature of the refrigerant discharged from the indoor heat exchanger 212. The discharge temperature sensor 243 may be electrically connected to the controller 191. The discharge temperature sensor 243 may transmit information about the temperature of the refrigerant discharged from the indoor heat exchanger 212 to the controller 191.

The air conditioner 1 may include a first pressure sensor 251. The first pressure sensor 251 may be connected to the low pressure pipe connector 322. The first pressure sensor 251 may measure a pressure of the refrigerant flowing in the low pressure pipe connector 322. The first pressure sensor 251 may be disposed between the low pressure valve 380 and the indoor heat exchanger 212. The first pressure sensor 251 may be disposed upstream of the low pressure valve 380. The first pressure sensor 251 may measure the refrigerant pressure inside of one of the plurality of indoor units 200. The first pressure sensor 251 may be electrically connected to the controller 191. The first pressure sensor 251 may transmit information about the refrigerant pressure of one of the plurality of indoor units 200 to the controller 191.

The air conditioner 1 may include a second pressure sensor 252. The second pressure sensor 252 may be connected to the low pressure pipe connector 322. The second pressure sensor 252 may measure the pressure of the refrigerant flowing in the low pressure pipe connector 322. The second pressure sensor 252 may be disposed between the low pressure valve 380 and the low pressure pipe 420. The second pressure sensor 252 may be disposed downstream of the low pressure valve 380. The second pressure sensor 252 may measure the pressure of the refrigerant flowing in the low pressure pipe 420. The second pressure sensor 252 may be electrically connected to the controller 191. The second pressure sensor 252 may transmit information about the refrigerant pressure in the low pressure pipe 420 to the controller 191. The second pressure sensor 252 may measure the pressure of low pressure gaseous refrigerant circulating in the outdoor unit 100.

Figure 2:
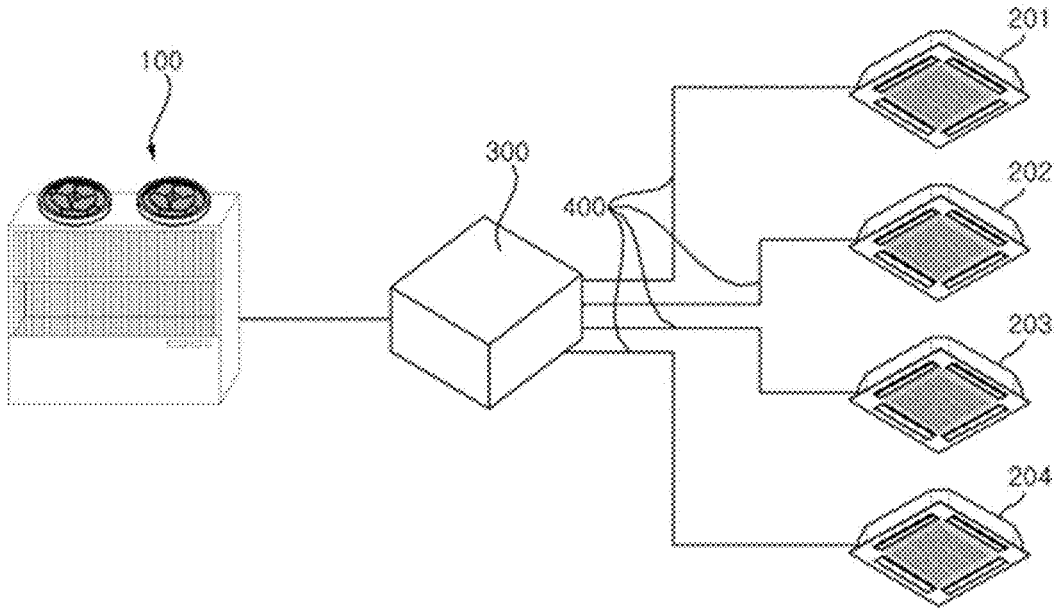
FIG. 2 is a schematic diagram of an air conditioner according to an embodiment.

Referring to FIG. 2, air conditioner 1 will be further described. FIG. 2 conceptually illustrates an entire system of the air conditioner 1.

The air conditioner 1 may include a plurality of indoor units 201, 202, 203, and 204. Each of the plurality of indoor units 201, 202, 203, and 204 may be disposed in a different space.

Each of the plurality of indoor units 201, 202, 203, and 204 may be connected to the outdoor unit 100. The switching device 300 may connect the outdoor unit 100 and the plurality of indoor units 201, 202, 203, and 204 through the refrigerant pipe 400.

When all of the plurality of indoor units 201, 202, 203, and 204 are switched to an Off state, noise may be generated due to a valve being driven within switching device 300. Accordingly, in order to suppress or prevent noise generation, a control method that does not turn off all of the plurality of indoor units 201, 202, 203, and 204 is needed.

Figure 3:
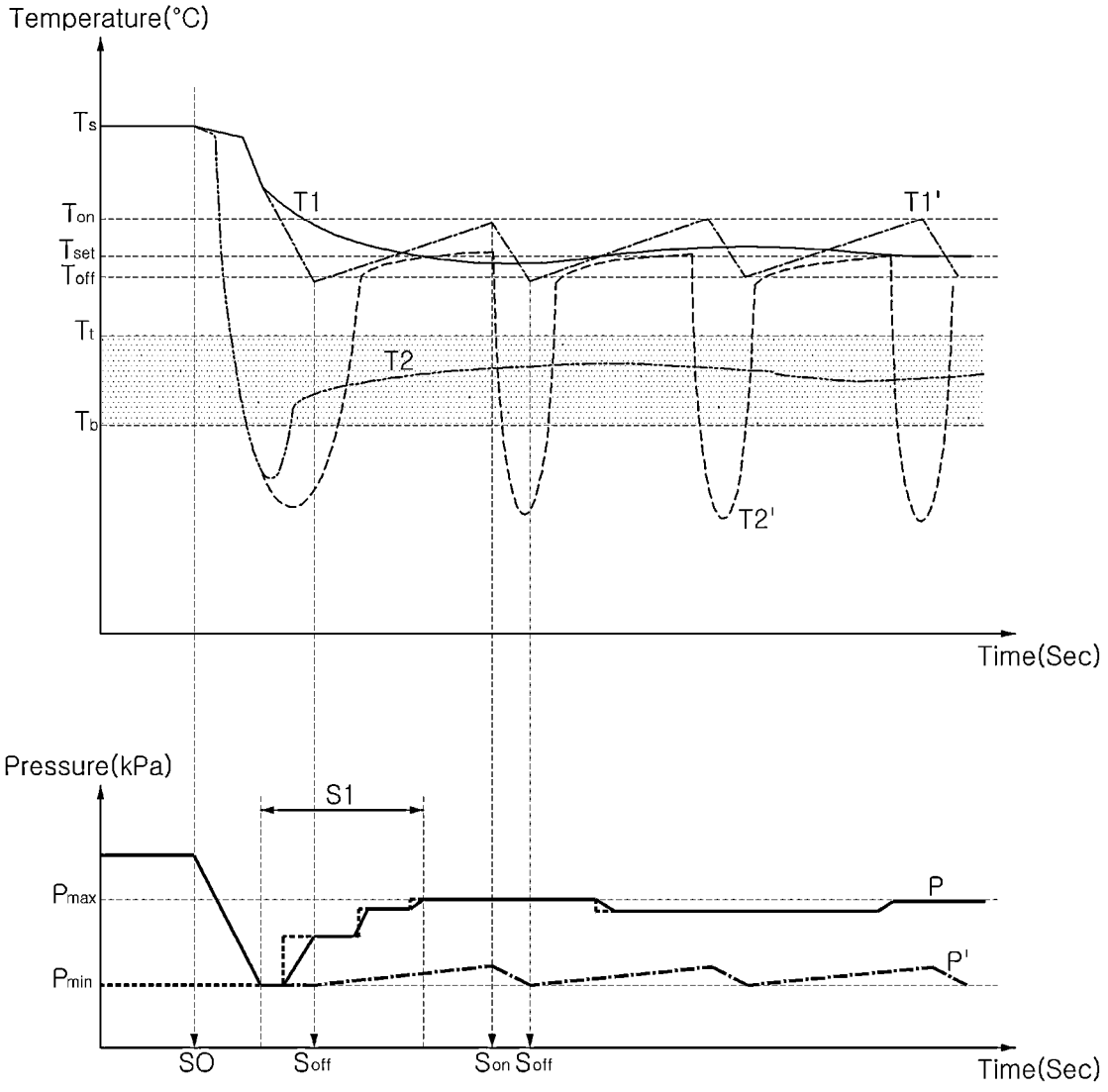
FIG. 3 is a graph explaining an operation of an air conditioner according to an embodiment.

Referring to FIG. 3, the air conditioner 1 will be further described. FIG. 3 is a graph showing temperature and pressure changes over time.

T1 diagram is a graph showing a change in indoor temperature over time when the air conditioner 1 according to an embodiment is driven. T2 diagram is a graph showing temperature change of air discharged from the indoor unit when the air conditioner 1 according to an embodiment is driven. T1' diagram is a graph showing change in indoor temperature over time when an air conditioner according to the related art is driven. T2' diagram is a graph showing temperature change of air discharged from the indoor unit when the air conditioner according to the related art is driven.

P diagram is a graph showing change in refrigerant pressure in one of the plurality of indoor units when the air conditioner 1 according to an embodiment is driven. P' diagram is a graph showing change in refrigerant pressure in one of a plurality of indoor units when the air conditioner according to the related art is driven.

The air conditioner may be operated for cooling. By driving the air conditioner, the indoor temperature may gradually decrease from an initial temperature (Ts).

The air conditioner may receive a set temperature (Tset). A user may input the desired set temperature (Tset) into the air conditioner.

The air conditioner may have a lower limit value (Toff). The lower limit value (Toff) may be lower than the set temperature (Tset). When the indoor temperature becomes lower than the lower limit value (Toff), the indoor unit may be turned off (Soff).

The air conditioner may have an upper limit value (Ton). The upper limit value (Ton) may be higher than the set temperature (Tset). When the indoor temperature becomes greater than the upper limit value (Ton), the indoor unit may be turned off.

The indoor unit of the air conditioner may maintain the temperature of the indoor space between the upper limit value (Ton) and the lower limit value (Toff). The indoor unit of the air conditioner may be turned off (Soff) when the temperature of the indoor space is outside of a range between the upper limit value (Ton) and the lower limit value (Toff). The indoor unit of the air conditioner may be turned on (Son) when the temperature of the indoor space is within the range between the upper limit value (Ton) and the lower limit value (Toff).

When the indoor unit is turned off, driving of indoor fan 212 (see FIG. 1) may be stopped. When the indoor unit is turned off, high pressure valve 370 (see FIG. 1) and low pressure valve 380 (see FIG. 1) may be closed.

When the indoor unit is turned on, the indoor fan 212 (see FIG. 1) may be driven. When the indoor unit is turned on, the high pressure valve 370 (see FIG. 1) may be closed and the low pressure valve 380 (see FIG. 1) may be opened.

The temperature of the air discharged from the indoor unit may decrease when the indoor unit is turned on. The temperature of the air discharged from the indoor unit may rise when the indoor unit is turned off.

The air conditioner may have an optimal range (Tb to Tt) of the discharge temperature of the indoor unit. The optimal range (Tb to Tt) may be the discharge temperature range of the indoor unit in which a user feels comfortable. The optimal range may have an optimal upper limit value (Tt). The optimal range may have an optimal lower limit value (Tb). The optimal range may be lower than the lower limit value (Toff) of the indoor temperature. When the temperature of the air discharged from the indoor unit is outside of the optimal range, the user may feel uncomfortable.

The air conditioner may increase an evaporation pressure after the indoor unit is driven (S0). The evaporation pressure may be the pressure of the refrigerant that passes through the indoor heat exchanger 212 (see FIG. 1) and is introduced into the low pressure pipe 420 (see FIG. 1). The evaporation pressure may be the pressure of the refrigerant flowing in the indoor unit operating in a cooling mode. The evaporation pressure may be a value measured by the first pressure sensor 251.

The air conditioner may include a pressure adjustable stroke S1. The pressure adjustable stroke S1 may be performed after the indoor unit is driven SO. The air conditioner may adjust the opening degree of the low pressure valve 380 (see FIG. 1) during the pressure adjustable stroke S1. By the pressure adjustable stroke S1 of the air conditioner, the pressure of the refrigerant evaporated passing through the indoor heat exchanger 212 (see FIG. 1) may be increased.

The air conditioner according to an embodiment may increase the evaporation pressure of the indoor unit in the cooling operation due to the pressure adjustable stroke S1 by adjusting the opening degree of the low pressure valve 380 (see FIG. 1). Accordingly, the air conditioner according to the related art may form the evaporation pressure (P') of the entire system including both the outdoor unit and a plurality of indoor units to be the same, whereas the air conditioner according to an embodiment may form the evaporation pressure (P) of individual indoor units in the cooling operation to be higher than the evaporation pressure (P') of the entire system. For this reason, the air conditioner according to an embodiment maintains the indoor temperature between the upper limit value (Ton) and the lower limit value (Toff), thereby preventing the indoor unit from turning off and suppressing or preventing noise generated by turning the indoor unit off. In addition, the air conditioner according to an embodiment may maintain the temperature of the air discharged from the indoor unit within an optimal range (Tb to Tt), providing a sense of comfort to a user. On the other hand, the air conditioner of the related art generates noise by turning off the indoor unit whenever the indoor temperature reaches the upper limit value (Ton) or the lower limit value (Toff), and causes discomfort to users because the temperature of the air discharged from the indoor unit is outside of the optimal range (Tb to Tt).

Figure 4:
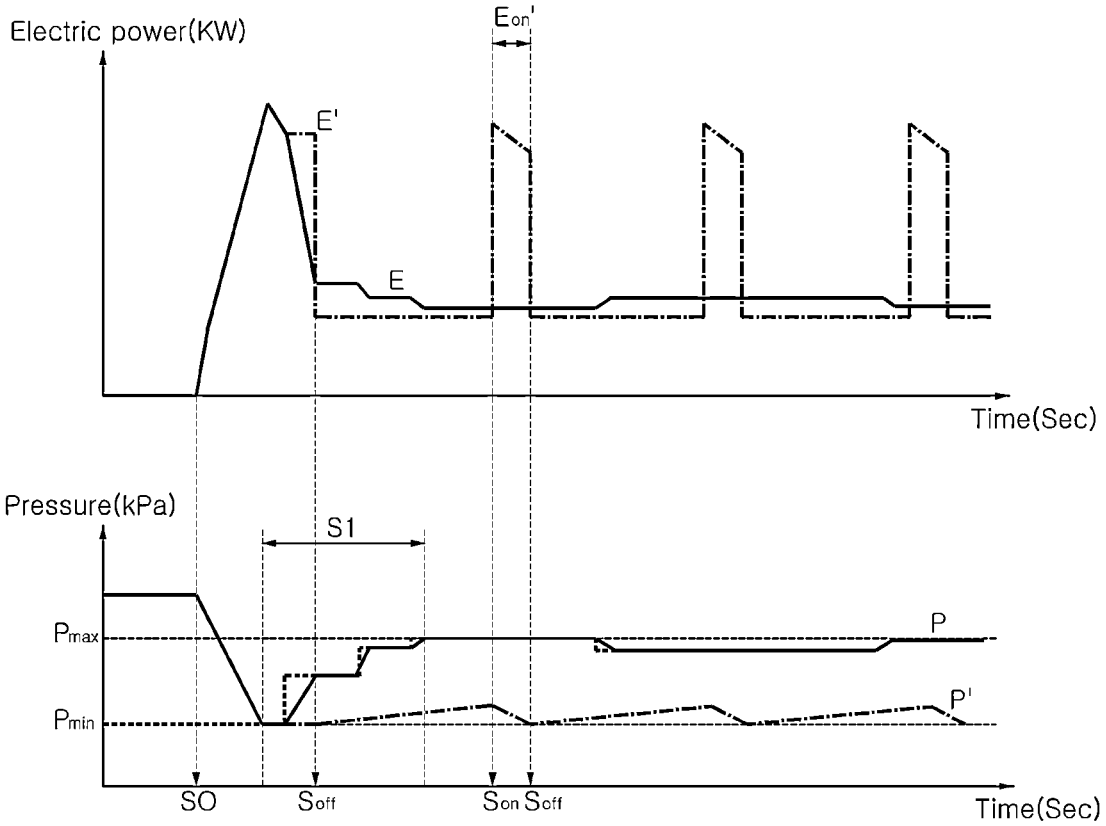
FIG. 4 is a graph explaining an operation of an air conditioner according to an embodiment.

Referring to FIG. 4, the air conditioner will be described. FIG. 4 is a graph showing power consumption and pressure change over time.

E diagram is a graph showing power consumption value over time when the air conditioner 1 according to an embodiment is driven. E' diagram is a graph showing power consumption value over time when the air conditioner according to the related art is driven.

The air conditioner 1 according to an embodiment may increase the evaporation pressure of the indoor unit in the cooling operation due to the pressure adjustable stroke S1 by adjusting the opening degree of the low pressure valve 380 (see FIG. 1). Accordingly, the indoor temperature value is formed between the upper limit value (Ton) and the lower limit value (Toff) (see FIG. 3), so that the indoor unit is maintained in an On state. On the other hand, in the air conditioner according to the related art, the indoor unit switches On and Off repeatedly according to changes in indoor temperature, so the power consumption (Eon') increases rapidly when the compressor is switched from Off to On by restarting the compressor. This is because the air conditioner of the related art has the same evaporation pressure (P') throughout the system, and a situation occurs where a plurality of indoor units is turned off simultaneously, causing the compressor to turn off.

Figure 5:
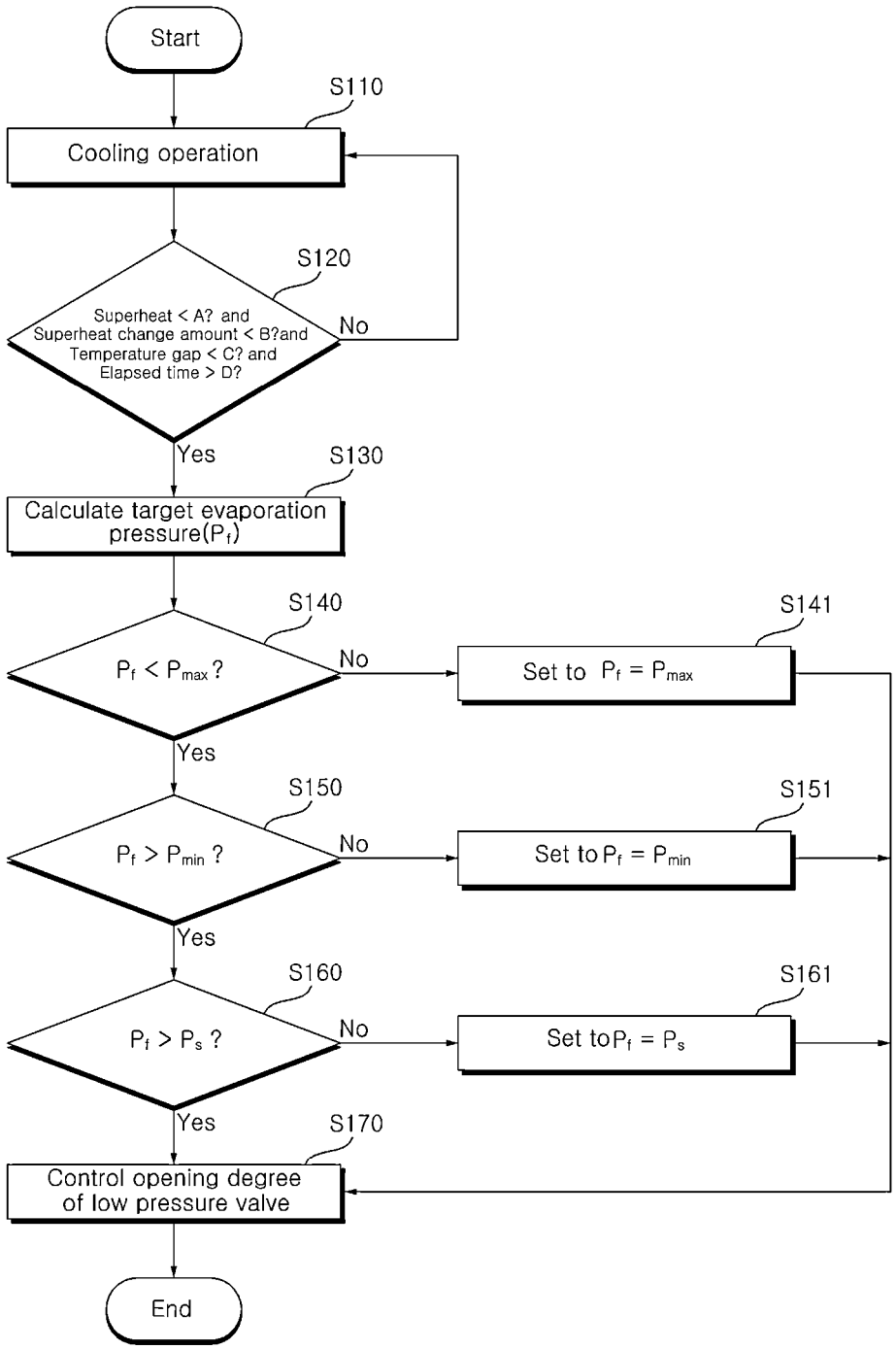
FIG. 5 is a control block diagram of an air conditioner according to an embodiment.

With reference to FIGS. 5 and 6, the air conditioner 1 will be further described.

FIG. 5 is a block diagram showing a method of controlling the air conditioner 1 according to an embodiment. FIG. 6 shows a formula used to control the air conditioner 1 according to an embodiment.

The air conditioner (1) may be operated for cooling (S110). The cooling operation may be an operation state in which the indoor heat exchanger 212 (see FIG. 1) functions as an evaporator, and the indoor heat exchanger 212 absorbs heat from air suctioned into the indoor unit 200.

The controller 191 may determine a stability of the indoor unit 200 (S120). The controller 191 may receive information about measured values from the room temperature sensor 241, the superheat sensor 242, and the discharge temperature sensor 243.

When a degree of superheat of the indoor unit 200 is less than a preset or predetermined limit value A, the controller 191 may determine that the indoor unit 200 is stable (S120). The controller 191 may determine that the indoor unit 200 is stable when the measured value of the superheat sensor 242 is less than a preset or predetermined limit temperature A. When the degree of superheat of the indoor unit 200 is greater than the preset limit value A, the controller 191 may continue the cooling operation (S110) of the indoor unit 200 without changing the opening degree of the valve 380.

When an amount of change in superheat of the indoor unit 200 is less than a preset or predetermined limit value B, the controller 191 may determine that the indoor unit 200 is stable (S120). The controller 191 may determine that the indoor unit 200 is stable when the amount of change in the measured value of the superheat sensor 242 during a unit time is less than the preset limit value (B). When the amount of change in superheat of the indoor unit 200 is greater than the preset limit value B, the controller 191 may continue the cooling operation (S110) of the indoor unit 200 without changing the opening degree of the valve 380.

When a temperature gap of the indoor unit 200 is smaller than a preset or predetermined limit value C, the controller 191 may determine that the indoor unit 200 is stable (S120). The temperature gap may be a difference between the measured value of the discharge temperature sensor 243 and the measured value of the superheat sensor 242 (M1). The controller 191 may determine that the indoor unit 200 is stable when the temperature gap is smaller than the preset limit value C. When the temperature gap of the indoor unit 200 is greater than the preset limit value C, the controller 191 may continue the cooling operation (S110) of the indoor unit 200 without changing the opening degree of the valve 380.

When an elapsed time since start of the cooling operation (S110) is greater than a preset or predetermined time limit D, the controller 191 may determine that the indoor unit 200 is stable (S120). The controller 191 may continue the cooling operation (S110) of the indoor unit 200 without changing the opening degree of the valve 380 when the elapsed time since the start of the cooling operation (S110) is less than the preset time limit D.

When it is determined that the indoor unit 200 is stable, the controller 191 may calculate a target evaporation pressure (Pf) of the indoor unit 200 (S130). The target evaporation pressure (Pf) may be a target value of the refrigerant pressure evaporated in the indoor heat exchanger 212. The target evaporation pressure (Pf) may be a final target value of the measured value of the first pressure sensor 251.

The target evaporation pressure (Pf) may be calculated by adding a correction value to a current refrigerant pressure (P) of the indoor unit 200 (M2). The correction value may be proportional to a difference between the set temperature (Tset) and the temperature (T1) of the current indoor space. $\alpha$ may be a constant.

The controller 191 may compare the target evaporation pressure (Pf) with an upper pressure limit value (Pmax) (S140). The upper pressure limit value (Pmax) is a maximum value of the refrigerant pressure flowing in the indoor unit 200 and may be a value input to the controller 191. When the target evaporation pressure (Pf) is calculated to be higher than the upper pressure limit value (Pmax), the controller 191 may set the target evaporation pressure (Pf) as the upper pressure limit value (Pmax) (S141).

The controller 191 may compare the target evaporation pressure (Pf) with a lower pressure limit value (Pmin) (S150). The lower pressure limit value (Pmin) is a minimum value of the refrigerant pressure flowing in the indoor unit 200 and may be a value input to the controller 191. When the target evaporation pressure (Pf) is calculated to be higher than the lower pressure limit value (Pmin), the controller 191 may set the target evaporation pressure (Pf) to the lower pressure limit value (Pmin) (S151).

The controller 191 may compare the target evaporation pressure (Pf) with a system evaporation pressure (Ps) (S160). The system evaporation pressure (Ps) may be the pressure of the low pressure gaseous refrigerant circulating in the outdoor unit 100. The system evaporation pressure (Ps) may be the refrigerant pressure in the low pressure pipe 420 or may be a value measured by the second pressure sensor 252. When the target evaporation pressure (Pf) is calculated to be less than the system evaporation pressure (Ps), the controller 191 may set the target evaporation pressure (Pf) to the system evaporation pressure (Ps) (S161).

The controller 191 may control the opening degree of the low pressure valve 380 (S170). The controller 191 may increase the pressure of the refrigerant circulating in the indoor unit 200 to the target evaporation pressure (Pf) by adjusting the opening degree of the low pressure valve 380.

An opening amount Li of the low pressure valve 380 may be calculated by adding a correction value to a current opening amount Li−1 of the low pressure valve 380 (M3). The correction value may be proportional to the difference between the target evaporation pressure (Pf) and the system evaporation pressure (Ps). 13 may be a constant. The controller 191 may open the low pressure valve 380 to the maximum when the target evaporation pressure (Pf) is set to the lower pressure limit value (Pmin) or the system evaporation pressure (Ps).

Embodiments disclosed herein solve the above and other issues.

Embodiments disclosed herein may supply comfortable air to users.

Embodiments disclosed herein may reduce power consumption of an air conditioner.

Embodiments disclosed herein may reduce the number of On/Off switching times of an indoor unit.

Embodiments disclosed herein may maintain a temperature in an indoor space constant.

Embodiments disclosed herein may maintain a temperature of the air discharged from the indoor unit constant.

Embodiments disclosed herein may facilitate control of the evaporation pressure of the indoor unit.

Advantages of embodiments disclosed herein are not limited to those mentioned above, and other advantages not mentioned herein will be clearly understood by those skilled in the art from the following description.

An air conditioner according to embodiments disclosed herein may include an outdoor unit provided with a compressor. The air conditioner may be connected to the outdoor unit, and include a plurality of indoor units disposed in different spaces, each having an indoor heat exchanger.

The air conditioner may connect the indoor heat exchanger and the compressor and include a low pressure pipe through which a low pressure gaseous refrigerant flows. The air conditioner may include a switching device having a low pressure valve disposed between the indoor heat exchanger and the low pressure pipe.

The air conditioner may include an indoor temperature sensor that measures a temperature of a space where the indoor unit is disposed. The air conditioner may include a controller that is electrically connected to the indoor temperature sensor and adjust an opening degree of the low pressure valve. The controller may increase an evaporation pressure of the indoor unit according to changes in indoor temperature by adjusting the opening degree of the low pressure valve based on the difference between a measured value of the indoor temperature sensor and a previously input set temperature.

A pressure of a refrigerant after passing through the indoor heat exchanger may be higher than a refrigerant pressure in the low pressure pipe. The air conditioner may include a first pressure sensor disposed between the indoor heat exchanger and the low pressure valve. The air conditioner may include a second pressure sensor disposed between the low pressure valve and the low pressure pipe. A measured value of the first pressure sensor may be greater than a measured value of the second pressure sensor.

The air conditioner may have a pressure adjustable stroke that increases a pressure of a refrigerant that is heat exchanged in the indoor heat exchanger. The controller may reduce the opening degree of the low pressure valve during the pressure adjustable stroke.

The air conditioner may be operated in a cooling mode to absorb heat from air heat exchanged in the indoor heat exchanger. The low pressure valve may remain open while the air conditioner is operating.

The air conditioner may include a superheat sensor that measures a temperature of a refrigerant flowing through the indoor heat exchanger. The controller may maintain the opening degree of the low pressure valve when a measured value of the superheat sensor is greater than a preset or predetermined limit value. The controller may maintain the opening degree of the low pressure valve when an amount of change in a measured value of the superheat sensor is greater than a preset limit value.

The air conditioner may include a discharge temperature sensor that measures the temperature of the refrigerant discharged from the indoor heat exchanger. The controller may maintain the opening degree of the low pressure valve when a temperature gap, which is a difference between measured values of the superheat sensor and the discharge temperature sensor, is greater than a preset limit value.

The controller may calculate a target evaporation pressure of a refrigerant pressure that is heat exchanged in the indoor heat exchanger. The controller may adjust the opening degree of the low pressure valve based on the target evaporation pressure. The target evaporation pressure may increase as the difference between the measured value of the indoor temperature sensor and the previously input set temperature increases.

The controller may set the target evaporation pressure to an upper pressure limit value when the calculated target evaporation pressure is greater than a preset or predetermined upper pressure limit value. The controller may set the target evaporation pressure to a lower pressure limit value when the calculated target evaporation pressure is less than a preset or predetermined lower pressure limit value.

The controller may set the target evaporation pressure to a system evaporation pressure when the calculated target evaporation pressure is less than a system evaporation pressure in the low pressure pipe. The controller may open the low pressure valve to the maximum when the target evaporation pressure is set to a preset or predetermined lower pressure limit value or a system evaporation pressure in the low pressure pipe. The controller may adjust the opening degree of the low pressure valve to be greater as a difference between the calculated target evaporation pressure and a system evaporation pressure in the low pressure pipe increases.

The air conditioner may include a high pressure pipe through which a high pressure gaseous refrigerant discharged from the compressor flows. The switching device may include a high pressure valve disposed between the high pressure pipe and the indoor heat exchanger. The controller may maintain the high pressure valve in a closed state.

The air conditioner may include a liquid pipe that supplies a liquid refrigerant to the indoor heat exchanger.

Details of other embodiments are included in the description and drawings.

According to at least one of the embodiments disclosed herein, comfortable air may be provided to users by maintaining a blowout temperature of the indoor unit constant.

According to at least one of the embodiments disclosed herein, power consumption generated by the compressor may be reduced by preventing restart of the compressor.

According to at least one of the embodiments disclosed herein, the frequency of On/Off switching of the indoor unit may be reduced by maintaining a blowout temperature of the indoor unit constant.

According to at least one of the embodiments disclosed herein, the evaporation pressure of the indoor unit may be easily controlled by adjusting the opening degree of the low pressure valve.

The benefits of embodiments disclosed herein are not limited to those mentioned above, and other benefits not mentioned herein will be clearly understood by those skilled in the art from the following description.

Hereinbefore, although embodiments have been disclosed for illustrative purposes, the embodiments are not limited to the specific exemplary embodiments and various modifications may be made by those skilled in the technical field to which the embodiments pertain without departing from the scope claimed in the claims, and such modifications should not be individually understood from technical concepts or prospects of the present disclosure.

The embodiments may be modified and implemented in various forms, so that the scope thereof is not limited to the above-described embodiments. Therefore, when the modified embodiments include components of the claims, it should be viewed as belonging to the scope.

Certain embodiments or other embodiments described above are not mutually exclusive or distinct from each other. Any or all elements of the embodiments of the disclosure described above may be combined with another or combined with each other in configuration or function.

For example, a configuration "A" described in one embodiment of the disclosure and the drawings and a configuration "B" described in another embodiment of the disclosure and the drawings may be combined with each other. Namely, although the combination between the configurations is not directly described, the combination is possible except in the case where it is described that the combination is impossible.

Although embodiments have been described with reference to a number of illustrative embodiments thereof, it should be understood that numerous other modifications and embodiments can be devised by those skilled in the art that will fall within the scope of the principles. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner, comprising:

an outdoor unit comprising a compressor;

a plurality of indoor units connected to the outdoor unit, each having an indoor heat exchanger and disposed in a different space;

a low pressure pipe that connects the indoor heat exchanger and the compressor and in which a low pressure gaseous refrigerant flows;

a switching device comprising a low pressure valve disposed between the indoor heat exchanger and the low pressure pipe;

an indoor temperature sensor that measures a temperature of a space in which an indoor unit of the plurality of indoor units is disposed; and a controller that is electrically connected to the indoor temperature sensor and adjusts an opening degree of the low pressure valve, wherein the controller adjusts the opening degree of the low pressure valve based on a difference between a temperature measured by the indoor temperature sensor and a previously input set temperature, and wherein the controller calculates a target evaporation pressure (Pf) of a refrigerant pressure that is heat exchanged in the indoor heat exchanger of the respective indoor unit, and adjusts the opening degree of the low pressure valve based on the target evaporation pressure.

2. The air conditioner of claim 1, wherein a pressure of a refrigerant after passing through the indoor heat exchanger is higher than a refrigerant pressure in the low pressure pipe.

3. The air conditioner of claim 1, further comprising:

a first pressure sensor disposed between the indoor heat exchanger of the respective indoor unit and the low pressure valve; and a second pressure sensor disposed between the low pressure valve and the low pressure pipe.

4. The air conditioner of claim 3, wherein a pressure measured by the first pressure sensor is greater than a pressure measured by the second pressure sensor.

5. The air conditioner of claim 1, wherein the air conditioner has a pressure adjustable stroke that increases a pressure of a refrigerant that is heat exchanged in the indoor heat exchanger of the respective indoor unit, and wherein the controller reduces the opening degree of the low pressure valve during the pressure adjustable stroke.

6. The air conditioner of claim 1, wherein the air conditioner is operated in a cooling mode in which heat is absorbed from air heat exchanged in the indoor heat exchanger, and wherein the low pressure valve remains open while the air conditioner is operated.

7. The air conditioner of claim 1, further comprising:

a superheat sensor that measures a temperature of a refrigerant flowing through the indoor heat exchanger of the respective indoor unit, wherein the controller maintains the opening degree of the low pressure valve when a measured value of the superheat sensor is greater than a predetermined limit value.

8. The air conditioner of claim 1, further comprising:

a superheat sensor that measures a temperature of a refrigerant flowing through the indoor heat exchanger of the respective indoor unit, wherein the controller maintains the opening degree of the low pressure valve when an amount of change in a value of measured by the superheat sensor is greater than a predetermined limit value.

9. The air conditioner of claim 1, further comprising:

a superheat sensor that measures a temperature of a refrigerant flowing through the indoor heat exchanger of the respective indoor unit; and a discharge temperature sensor that measures the temperature of the refrigerant discharged from the indoor heat exchanger, wherein the controller maintains the opening degree of the low pressure valve when a temperature gap, which is a difference between measured values of the superheat sensor and the discharge temperature sensor, is greater than a predetermined limit value.

10. The air conditioner of claim 1, wherein the target evaporation pressure increases as a difference between the measured value of the indoor temperature sensor and the previously input set temperature increases.

11. The air conditioner of claim 1, wherein the controller sets the target evaporation pressure to an upper pressure limit value when the calculated target evaporation pressure is greater than a predetermined upper pressure limit value (Pmax).

12. The air conditioner of claim 1, wherein the controller sets the target evaporation pressure to a lower pressure limit value when the calculated target evaporation pressure is less than a predetermined lower pressure limit value (Pmin).

13. The air conditioner of claim 1, wherein the controller sets the target evaporation pressure to a system evaporation pressure when the calculated target evaporation pressure is less than a system evaporation pressure (Ps) in the low pressure pipe.

14. The air conditioner of claim 1, wherein the controller opens the low pressure valve to a maximum when the target evaporation pressure is set to a predetermined lower pressure limit value or a system evaporation pressure in the low pressure pipe.

15. The air conditioner of claim 1, wherein the controller adjusts the opening degree of the low pressure valve to be greater as a difference between the calculated target evaporation pressure and a system evaporation pressure (Ps) in the low pressure pipe increases.

16. The air conditioner of claim 1, further comprising:

a high pressure pipe in which high pressure gaseous refrigerant discharged from the compressor flows, wherein the switching device comprises a high pressure valve disposed between the high pressure pipe and the indoor heat exchanger, and wherein the controller maintains the high pressure valve in a closed state.

17. The air conditioner of claim 1, further comprising:

a high pressure pipe in which high pressure gaseous refrigerant discharged from the compressor flows; and a liquid pipe that supplies liquid refrigerant to the indoor heat exchanger.

18. An air conditioner, comprising:

an outdoor unit comprising a compressor;

a plurality of indoor units connected to the outdoor unit, each having an indoor heat exchanger and disposed in a different space;

a low pressure pipe that connects the indoor heat exchanger and the compressor and in which a low pressure gaseous refrigerant flows;

a switching device comprising a low pressure valve disposed between the indoor heat exchanger and the low pressure pipe;

an indoor temperature sensor that measures a temperature of a space in which an indoor unit of the plurality of indoor units is disposed;

a first pressure sensor disposed between the indoor heat exchanger of the respective indoor unit and the low pressure valve;

a second pressure sensor disposed between the low pressure valve and the low pressure pipe; and a controller that is electrically connected to the indoor temperature sensor and adjusts an opening degree of the low pressure valve, wherein the controller adjusts the opening degree of the low pressure valve based on a difference between a temperature measured by the indoor temperature sensor and a previously input set temperature.

19. The air conditioner of claim 18, wherein a pressure measured by the first pressure sensor is greater than a pressure measured by the second pressure sensor.

20. The air conditioner of claim 18, wherein a pressure of a refrigerant after passing through the indoor heat exchanger is higher than a refrigerant pressure in the low pressure pipe.

* * * * *